US007314085B2

(12) United States Patent
Hopper et al.

(10) Patent No.: US 7,314,085 B2
(45) Date of Patent: Jan. 1, 2008

(54) WELL OPERATIONS SYSTEM

(75) Inventors: Hans Paul Hopper, Aberdeen (GB); Thomas G. Cassity, Surrey (GB)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 11/077,587

(22) Filed: Mar. 10, 2005

(65) Prior Publication Data

US 2005/0155774 A1 Jul. 21, 2005

Related U.S. Application Data

(60) Division of application No. 10/366,173, filed on Feb. 13, 2003, now Pat. No. 7,093,660, and a division of application No. 09/657,018, filed on Sep. 7, 2000, now Pat. No. 6,547,008, which is a continuation of application No. 09/092,549, filed on Jun. 5, 1998, now abandoned, which is a division of application No. 08/679,560, filed on Jul. 12, 1996, now Pat. No. 6,039,119, which is a continuation of application No. 08/204,397, filed as application No. PCT/US93/05246 on May 28, 1993, now Pat. No. 5,544,707.

(51) Int. Cl.
*E21B 33/043* (2006.01)

(52) U.S. Cl. ..... 166/348; 166/85.3; 166/88.4; 166/89.1; 166/368

(58) Field of Classification Search ..... 166/368, 166/348, 89.1, 88.4, 85.3; 73/49.3, 49.1
See application file for complete search history.

(56) References Cited

U.S. PATENT DOCUMENTS 2,094,812 A 10/1937 Penick et al.
2,478,628 A * 8/1949 Hansen ..... 73/46
2,889,886 A 6/1959 Gould
3,279,536 A 10/1966 Wakefield, Jr.
3,295,600 A 1/1967 Brown et al.
3,451,481 A * 6/1969 Lanmon ..... 166/313
3,971,576 A 7/1976 Herd et al.
4,109,942 A * 8/1978 Morrill ..... 285/123.13

(Continued)

FOREIGN PATENT DOCUMENTS

EP 0 489 142 1/1997

(Continued)

OTHER PUBLICATIONS

SPE 23145; Installation of Concentric Subsea Completions From a Jack-Up in the Wellhead Field: A Case History: Sep. 3-6, 1991: R. O. Sanders (pp. 405-415) (15 sheets drawings).

(Continued)

*Primary Examiner*—Hoang Dang
(74) *Attorney, Agent, or Firm*—Conley Rose, P.C.

(57) ABSTRACT

A wellhead has, instead of a conventional Christmas tree, a spool tree (34) in which a tubing hanger (54) is landed at a predetermined angular orientation. As the tubing string can be pulled without disturbing the tree, many advantages follow, including access to the production casing hanger (21) for monitoring production casing annulus pressure, and the introduction of larger tools into the well hole without breaching the integrity of the well.

20 Claims, 16 Drawing Sheets

U.S. PATENT DOCUMENTS

| | | | | | |
|---|---|---|---|---|---|
| 4,116,044 | A | * | 9/1978 | Garrett | 73/40.5 R |
| 4,154,302 | A | | 5/1979 | Cagini | |
| 4,415,186 | A | * | 11/1983 | Maestrami | 385/123.6 |
| 4,455,040 | A | * | 6/1984 | Shinn | 285/123.12 |
| 4,569,540 | A | * | 2/1986 | Beson | 285/93 |
| 4,593,914 | A | * | 6/1986 | Johnson | 277/322 |
| 4,887,672 | A | | 12/1989 | Hynes | |
| 5,092,401 | A | | 3/1992 | Heynen | |
| 5,143,158 | A | | 9/1992 | Watkins et al. | |
| 5,544,707 | A | | 8/1996 | Hopper et al. | |
| 5,575,336 | A | | 11/1996 | Morgan | |
| 5,941,310 | A | | 8/1999 | Cunningham et al. | |
| 5,975,210 | A | | 11/1999 | Wilkins et al. | |
| 6,003,602 | A | | 12/1999 | Wilkins | |
| 6,039,119 | A | | 3/2000 | Hopper et al. | |
| 6,227,300 | B1 | | 5/2001 | Cunningham et al. | |
| 6,293,345 | B1 | | 9/2001 | Watkins | |
| 6,302,212 | B1 | | 10/2001 | Nobileau | |
| 6,360,822 | B1 | | 3/2002 | Robertson | |
| 6,453,944 | B2 | | 9/2002 | Bartlett | |
| 6,470,968 | B1 | | 10/2002 | Turner | |
| 6,516,861 | B2 | | 2/2003 | Allen | |
| 2003/0051878 | A1 | | 3/2003 | DeBerry | |
| 2003/0192698 | A1 | | 10/2003 | Dallas | |

FOREIGN PATENT DOCUMENTS

| | | |
|---|---|---|
| EP | 0 572 732 | 8/1998 |
| EP | 0 989 283 | 3/2000 |
| EP | 0 719 905 | 2/2001 |
| GB | 2192921 | 1/1988 |
| WO | WO 86/01852 | 3/1986 |
| WO | WO 92/00438 | 1/1992 |
| WO | WO 99/18329 | 4/1999 |
| WO | WO 00/47864 | 8/2000 |
| WO | WO 01/73254 | 10/2001 |
| WO | WO 01/73256 | 10/2001 |
| WO | WO 01/73257 | 10/2001 |
| WO | WO 01/73259 | 10/2001 |
| WO | WO 01/73260 | 10/2001 |

OTHER PUBLICATIONS

Cooper Oil Tool; Phillips Petroleum Company Ann Subsea Facility: TMH0445; Nov. 1991; (pp. CCH 36064-36223).
Kvaerner Opposition EP 0719905 with exhibits; Nov. 29, 2001 (pp. 232).
FMC Opposition EP 0719905 with exhibits; Dec. 5, 2001 (pp. 128).
Cameron Response to FMC Opposition; Jun. 18, 2002; (pp. 14).
Cameron Response to Kvaerner Opposition with Scott Depo. Exhibit; Jun. 18, 2002; (pp. 29).
FMC Reply to Cameron Response; Jun. 17, 2003; (pp. 13).
EPO Preliminary Opinion; Feb. 16, 2005; (pp. 14.
Decision Rejecting the Opposition to EP 0 719 905 (Article 102 (2) EPC); Dated Aug. 5, 2005; (pp. 22).
Minutes of the Oral proceedings before the Opposition Division EP 0 719 905 with colored exhibit dated Aug. 5, 2005; (pp. 11).
*Cameron International Corporation* v. *Dril-Quip, Inc.*; C.A. No. 06-728; Amended Complaint for Patent Infringement dated Mar. 16, 2007; (pp. 5).
*Cameron International Corporation* v. *Dril-Quip, Inc.*; C.A. No. 06-728; Defendant Dril-Quip, Inc's Answer, Defenses, and Counterclaims in Response to Plaintiff's Amended Complaint for Patent Infringement dated Apr. 4, 2007.
*Cameron International Corporation* v. *Dril-Quip, Inc.*; C.A. No. 06-728; Plaintiff Cameron International Corporation's Answer to Defendant Dril-Quip, Inc's Counterclaims; with Exhibit A, U.S. Patent 6,039,119 (pp. 68) dated Apr. 25, 2007.
Decision Rejecting The Opposition to European Patent EP 0 572 732 Dated Mar. 19, 2002 (pp. 14).
Scott, Peter A. Depo. Upon Written Questions, vol. 1, pp. 1-21 dated Jan. 8, 2003.
Written Submissions before oral proceedings on Jun. 29, 2005 for Opposition to EP 0 719 905 with Exhibits K9-K21 dated Apr. 29, 2005 (pp. 27).
Deposition of Sigbjorn Sangesland (pp. 79-85, 301-317 dated Oct. 27, 1999 (pp. 25).
Declaration of Sigbjorn Sangesland (undated) (pp. 14).
Declaration of Michael Capesius (pp. 10) with Exhibits A-H; dated May 5, 2003.
Subsea 91 International conference; Delegate & Exhibitor List; Undated (pp. 7).
Declaration of Peter Scott (pp. 7); with Exhibits A-G dated May 8, 2003 (pp. 37).
Deposition of James Reid dated Apr. 30, 2003; (pp. 105).
Deposition of Michael Coulthard dated Apr. 25, 2003 (pp. 1-53).
Deposition of David Lorimer dated Apr. 23, 2003 (pp. 1-57).
Deposition of Frank Close dated Apr. 24, 2003; (pp. 22).
Deposition of Stephen A. Hatton dated May 7, 1998 (pp. 1-40).
Decision dated May 14, 2002; from United States Court of Appeals (pp. 15).
Deposition of Hans Hopper, vol. II, dated Jan. 19, 1998; (pp. 229-452.
Deposition of Peter Scott, vol. 1, dated Sep. 18, 1998; (pp. 1-44).
Written Submissions of Patentee Cooper Cameron in reply to Preliminary Opinion of the Opposition Division with Exhibits dated Apr. 29, 2005; (pp. 22).
Deposition of Peter Scott, vol. 1, Sep. 18, 1998 (pp. 12).
Findings of Fact, Conclusions of Law, and Order Findings of Fact dated Jan. 25, 2005 (pp. 25).
EPO Declaration of Mark Carter; dated Apr. 28, 2005 (pp. 13).
Sangesland; Norwegian Institute of Technology, Trondheim; *Electric Submersible Pump for Subsea Completed Wells*; Dated Nov. 26-27, 1991; (pp. 14).
Mathias *Owe*, The Norwegian Institute of Technology, Trondheim, Dec. 1991; (pp. 149).
Deposition of Sigbjorn Sangesland; dated Oct. 28, 1999; (pp. 17).
Notice of Appeal of Rejection of Opposition to EP 0 719 905 dated Oct. 20, 2005 with Statement of Grounds of Appeal dated Dec. 9, 2005; (pp. 15).
Statement of Patentee In Reply to Opponent's Statement of Grounds for Appeal of the Decision Upholding EP 0 719 905, dated Jun. 30, 2006 (pp. 25).
Opponent's Response to Patentee's Reply to Opponent's Statement of Grounds of Appeal, dated Nov. 17, 2006 oo, 5(.
Huber, et al; SPE 13976/1; *Through Bore Subsea Christmas Trees*; (Copyright 1985); Dated Sep. 10-13, 1985.
SPE 23050 P.A. Scott, M. Bowring, B. Coleman; *Electrical Submersible Pumps in Subsea Completions*, Sep. 3-6, 1991; (pp. 7).
OTC 5689; D.S. Huber et al., *The Subsea Systems of the Argyll Area Fields*; Dated May 2-5, 1988; (pp. 10).
D. S. Huber et al.; *The Development of the 7-1/16 Through-Bore Christmas Treei*; (Undated), (pp. 8).
Underwater Technology Conference; Dated 1990; *Subsea Production Systems: The Search for Cost-Effective Technology*; Dated Mar. 19-21, 1990 (pp. 15).
Sigbjorn Sangesland; Subsea Production Technology; *Simplified Subsea System Design*; Dated Oct. 23-27 and Nov. 20-24, 1989; (pp. 32).
Kvaerner Notice of Opposition filed against EP Patent 0 989 283 dated May 14, 2003 (pp. 23).
FMC Technologies Limited Opposition to EP Patent 0 989 283 dated May 13, 2005 with Annex 1 and 2.
ABB Vetco Gray's Notice of Opposition to EP Patent 0 989 283 dated May 8, 2003 (pp. 39).
Headworth, Colin, et al.; Advances in Underwater Technology, Ocean Science and Offshore Engineering, vol. 20, Second Generation; *Advances in Riserless Intervention for Subsea Well Servicing*; 1989; (pp. 11-18).
Hopper, C. T.; SPE 18239, *Simultaneous Wireline Operations From a Floating Vessel Using a Subsea Lubricator*; Society of Petroleum Engineers; Oct. 2-5, 1988; (pp. 23-30).
Stipulation Regarding the Agreed Definition of the Terms Workover Port, Workover Passageway, and Workover Flowpath in United States Patent Nos. 5,544,707 and 6,039,119 (pp. 1).

American Petroleum Institute, Petroleum Industry Data Exchange (PIDX) Committee; *PIDX Petroleum Industry Data Dictionary* (*PIDD*); dated May 7, 2003; (pp. 4).

Deposition of Hans Paul Hopper dated Jan. 21, 1998 (pp. 453-693).

* cited by examiner

WELL OPERATIONS SYSTEM

This application is a divisional of application Ser. No. 10/366,173 filed Feb. 13, 2003 now U.S. Pat. No. 7,093,660 which is a divisional application of copending application Ser. No. 09/657,018 filed Sep. 7, 2000 now U.S. Pat. No. 6,547,008 which is a continuation of application Ser. No. 09/092,549 filed Jun. 5, 1998 now abandoned which is a divisional continuing application of Ser. No. 08/679,560 filed Jul. 12, 1996, now U.S. Pat. No. 6,039,119, which is a continuation of Ser. No. 08/204,397 filed Mar. 16, 1994, now U.S. Pat. No. 5,544,707, which claims the benefit of PCT application PCT/US93/05246 filed on May 28, 1993, which claims the priority of European Patent Office application 92305014 filed on Jun. 1, 1992, all of the above hereby incorporated herein by reference.

Conventionally, wells in oil and gas fields are built up by establishing a wellhead housing, and with a drilling blow out preventer stack (BOP) installed, drilling down to produce the well hole whilst successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

A further difficulty which exists, particularly with subsea wells, is in providing the proper angular alignment between the various functions, such as fluid flow bores, and electrical and hydraulic lines, when the wellhead equipment, including the tubing hanger, Christmas tree, BOP stack and emergency disconnect devices are stacked up.

Exact alignment is necessary if clean connections are to be made without damage as the devices are lowered into engagement with one another. This problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further misalignment" can arise from the manner in which the guide base is bolted to the conductor casing of the wellhead.

In accordance with the present invention, a wellhead comprises a wellhead housing; a spool tree fixed and sealed to the housing, and having at least a lateral production fluid outlet port connected to an actuated valve; and a tubing hanger landed within the spool tree at a predetermined angular position at which a lateral production fluid outlet port in the tubing hanger is in alignment with that in the spool tree.

With this arrangement, the spool tree, takes the place of a conventional Christmas tree but differs therefrom in having a comparatively large vertical through bore without any internal valves and at least large enough to accommodate the tubing completion. The advantages which are derived from the use of such spool tree are remarkable, in respect to safety and operational benefits.

Thus, in workover situations the completion, consisting essentially of the tubing string, can be pulled through a BOP stack, without disturbing the spool tree and hence the pressure integrity of the well, "hereafter full production casing drift access is provided to the well through the large bore in the spool tree. The BOP can be any appropriate workover BOP or drilling BOP of opportunity and doe" not have to be one specially set up for that well.

Preferably, there are complementary guide mean" on the tubing hanger and spool tree to rotate the tubing hanger into the predetermined angular position relatively to the spool tree as the tubing hanger is lowered on to its landing. With this feature the spool tree can be landed at any angular orientation onto the wellhead housing and the guide means ensures that the tubing string will rotate directly to exactly the correct angular orientation relatively to the spool tree quite independently of any outside influence. The guide means to control rotation of the tubing hanger into the predetermined angular orientation relatively to the spool tree may be provided by complementary oblique edge surfaces one facing downwardly on an orientation sleeve depending from the tubing hanger the other facing upwardly on an orientation sleeve carried by the spool tree.

Whereas modern well technology provides continuous access to the tubing annulus around the tubing string, it has generally been accepted as being difficult, if not impossible, to provide continuous venting and/or monitoring of the pressure in the production casing annulus, that is the annulus around the innermost casing string. This has been because the production casing annulus must be securely sealed whist the Christmas tree is fitted in place of the drilling BOP, and the Christmas tree has only been fitted after the tubing string and hanger has been run in, necessarily inside the production casing hanger, so that the production casing hanger is no longer accessible for the opening of a passageway from the production casing annulus. However, the new arrangement, wherein the spool tree is fitted before the tubing string is run in provides adequate protected access through the BOP and spool tree to the production casing hanger for controlling a passage from the production casing annulus.

For this purpose, the wellhead may include a production casing hanger landed in the wellhead housing below the spool tree; an isolation sleeve which is sealed at its lower end to the production casing hanger and at its upper end to the spool tree to define an annular void between the isolation sleeve and the housing; and an adapter located in the annular space and providing part of a passage from the production casing annulus to a production casing annulus pressure monitoring port in the spool tree, the adapter having a valve for opening and closing the passage, and the valve being operable through the spool tree after withdrawal of the isolation sleeve up through the spool tree. The valve may be provided by a gland nut, which can be screwed up and down within a body of the adapter to bring parts of the passage formed in the gland nut and adapter body, respectively, into and out of alignment with one another. The orientation sleeve for the tubing hanger may be provided within the isolation sleeve.

Production casing annulus pressure monitoring can then be set up by method of completing a cased well in which a production casing hanger is fixed and sealed by a seal assembly to a wellhead housing, the method comprising, with BOP installed on the housing, removing the seal assembly and replacing it with an adapter which is manipulatable between configurations in which a passages from the production casing annulus up past the production casing hanger is open or closed; with the passage closed, removing the BOP and fitting to the housing above the production casing hanger a spool tree having an internal landing for a tubing hanger, installing a BOP on the spool tree; running a tool down through the BOP and spool tree to manipulate the valve and open the passage; inserting through the BOP and spool tree an isolation sleeve, which seals to both the production casing and spool tree and hence defines between the sleeve and casing an annular void through which the passage leads to a production caning annulus pressure monitoring port in the spool tree; and running a tubing string down through the BOP and spool tree until the tubing hanger lands in the spool tree with lateral outlet ports in the tubing hanger and spool tree for production fluid flow, in alignment with one another.

According to a further feature of the invention the spool tree has a downwardly depending location mandrel which is a close sliding fit within a bore of the wellhead housing. The close fit between the location mandrel of the spool tree and the wellhead housing provides a secure mounting which transmits inevitable bending stresses to the housing from the heavy equipment, such as a BOP, which projects upwardly from the top of the wellhead housing, without the need for excessively sturdy connections. The location mandrel may be formed as an integral part of the body of the spool tree, or may be a separate part which is securely fixed, oriented and sealed to the body.

Pressure integrity between the wellhead housing and spool tree may be provided by two seals positioned in series one forming an environmental seal (such as an AX gasket) between the spool tree and the wellhead housing, and the other forming a production seal between the location mandrel and either the wellhead housing or the production casing hanger.

During workover operations, the production casing annulus can be resealed by reversing the above steps, if necessary after setting plugs or packers down hole.

When production casing pressure monitoring is unnecessary, so that no isolation sleeve is required, the orientation sleeve carried by the spool tree for guiding and rotating the tubing hanger down into the correct angular orientation may be part of the spool tree location mandrel itself.

Double barrier isolation, that is to say two barriers in series, are generally necessary for containing pressure in a well. If a spool tree is used instead of a conventional Christmas tree, there are no valves within the vertical production and annulus fluid flow bores within the tree, and alternative provision must be made for sealing the bore or bores through the top of the spool tree which provide for wire line or drill pipe access.

In accordance with a further feature of the invention, at least one vertical production fluid bore in the tubing hanger is sealed above the respective lateral production fluid outlet port by means of a removable plug, and the bore through the spool tree being sealed above the tubing hanger by means of a second removable plug.

With this arrangement, the first plug, take the function of a conventional swab valve, and may be a wireline set plug. The second plug could be a stopper set in the spool tree above the tubing hanger by, e.g., a drill pipe running tool. The stopper could contain at least one wireline retrievable plug which would allow well access when only wire line operations are called for. The second plug should seal and be locked internally into the spool tree as it performs a barrier to the well when a BOP or intervention module is deployed. A particular advantage of this double plug arrangement is that, as is necessary to satisfy authorities in some jurisdictions, the two independent barriers are provided in mechanically separate parts, namely the tubing hanger and its plug and the second plug in the spool tree.

A further advantage arises if a workover port extends laterally through the wall of the spool tree from between the two plugs; a tubing annulus fluid port extends laterally through the wall of the spool tree from the tubing annulus; and these two ports through the spool tree are interconnected via an external flow line containing at least one actuated valve. The bore from the tubing annulus can then terminate at the port in the spool tree and no wireline access to the tubing annulus bore is necessary through the spool tree as the tubing annulus bore can be connected via the interplug void to choke or kill lines, i.e. a BOP annulus, so that downhole circulation is still available. It is then only necessary to provide wireline access at workover situations to the production bore or bores. This considerably simplifies workover BOP and/or riser construction. When used in conjunction with the plug at the top of the spool tree, the desirable double barrier isolation is provided by the spool tree plug over the tubing hanger, or workover valve from the production flow.

When the well is completed as a multi production bore well, in which the tubing hanger has at least two vertical production through bores each with a lateral production fluid flow port aligned with the corresponding port in the spool tree, at least two respective connectors may be provided for selective connection of a single bore wire line running tool to one or other of the production bores, each connector having a key for entering a complementary formation at the top of the spool tree to locate the connector in a predetermined angular orientation relatively to the spool tree. The same type of alternative connectors may be used for providing wireline or other running tool access to a selected one of a plurality of functional connections, e.g. electrical or hydraulic couplings, at the upper end of the tubing hanger.

The development and completion of a subsea wellhead in accordance with the present invention are illustrated in the accompanying drawings, in which.

Figure 1:
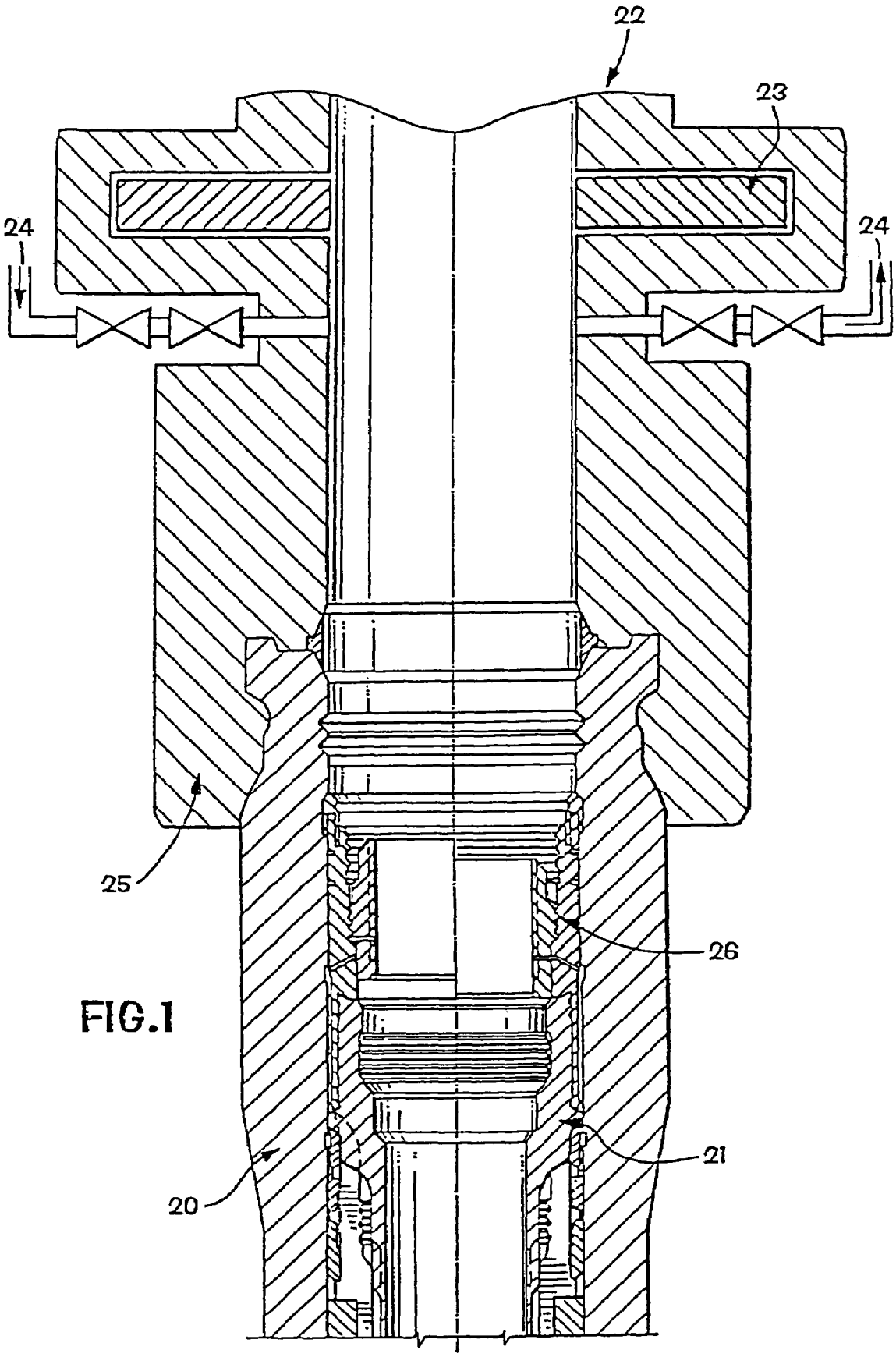
FIGS. 1 to 8 are vertical axial sections showing successive steps in development and completion of the wellhead, the Figure numbers bearing the letter A being enlargements of part of the corresponding Figures of same number without the A.

FIG. 1 shows the upper end of a cased well having a wellhead housing 20, in which casing hangers, including an uppermost production casing hanger 21 for, for example, 9⅝" or 10¾", production casing is mounted in conventional manner. FIG. 1 shows a conventional driling BOP 22 having rams 23 and kill and choke lines 24 connected to the upper end of the housing 20 by a drilling connector 25.

Figure 1A:
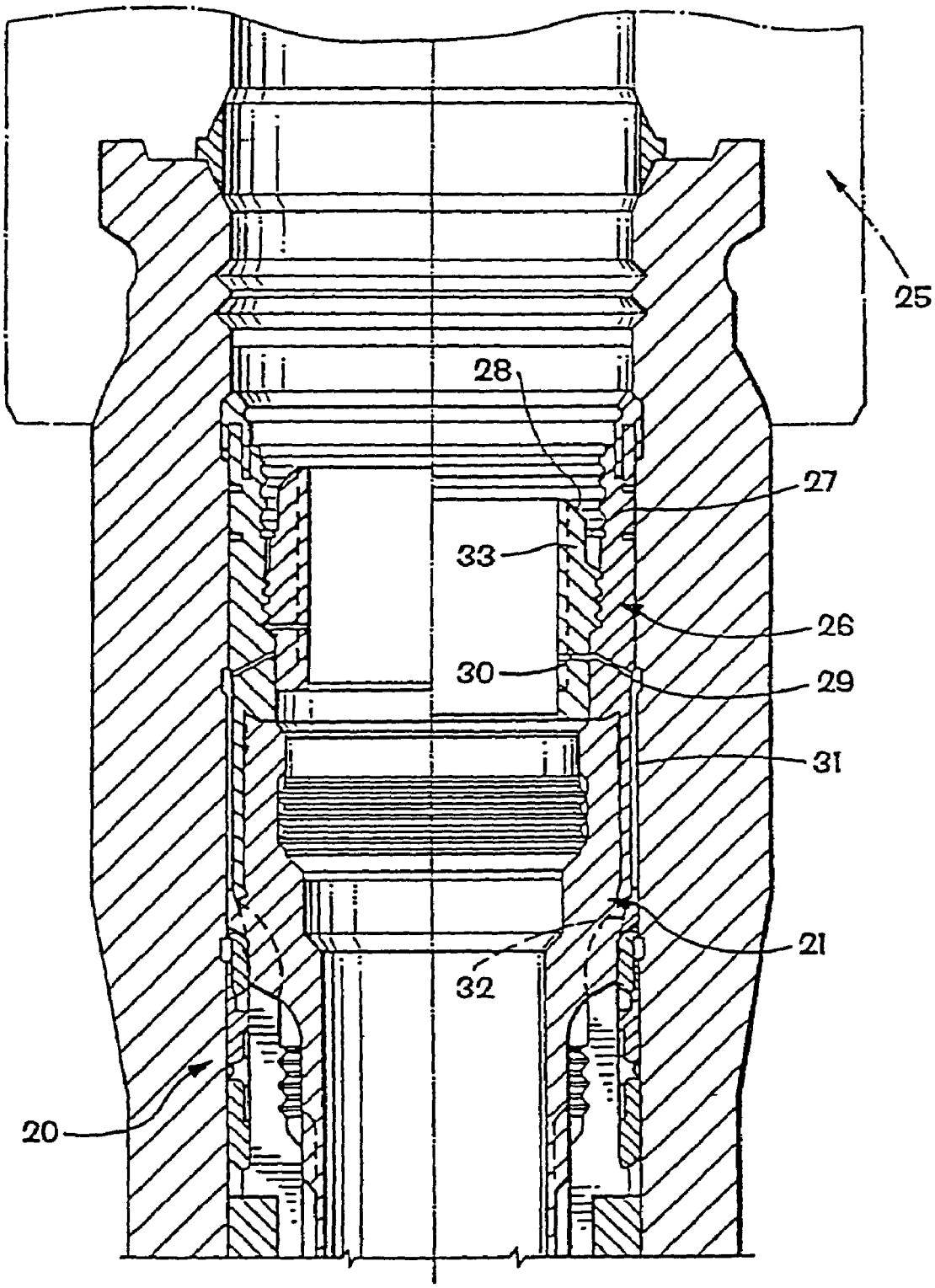

As seen in more detail in FIG. 1A, the usual mechanical seal assemblies between the production casing hanger 21 and the surrounding wellhead housing 20 have been removed and replaced through the BOP with an adapter 26 consisting of an outer annular body part 27 and an inner annular gland nut 28 which has a screw threaded connection to the body 27 so that it can be screwed between a lowered position shown on the right hand side of FIG. 1A, in which radial ducts 29 and 30, respectively in the body 27 and nut 28, are in communication with one another, and a raised position shown on the left hand side of FIG. 1A, in which the ducts are out of communication with one another. The duct 29 communicates through a conduit 31 between a depending portion of the body 27 and the housing 20, and through a conduit 32 passing through the production casing hanger 21, to the annulus surround the production casing. The duct 30 communicates through channels 33 formed in the radially inner surface of the nut 28, and hence to a void to be described. The cooperation between the gland nut 28 and body 27 of the adapter therefore acts as a valve which can open and close a passage up past the production casing hanger from the production casing annulus. After appropriate testing, a tool is run in through the BOP and, by means by radially projecting spring lugs engaging in the channels 33, rotates the gland nut 28 to the valve closed position shown on the right hand side on FIG. 1A. The well is thus resealed and the drilling BOP 22 can temporarily be removed.

Figure 2:
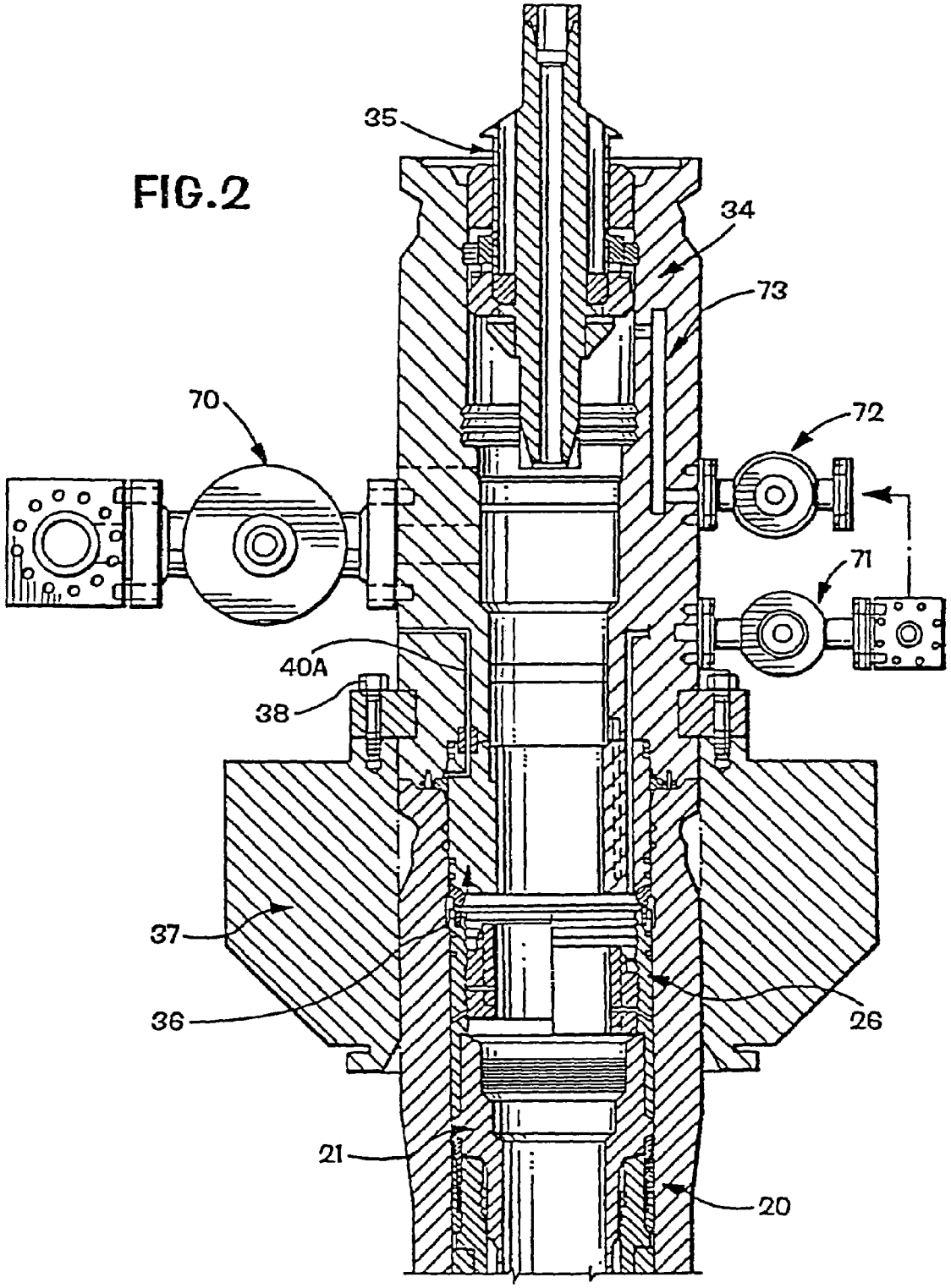
Figure 2A:
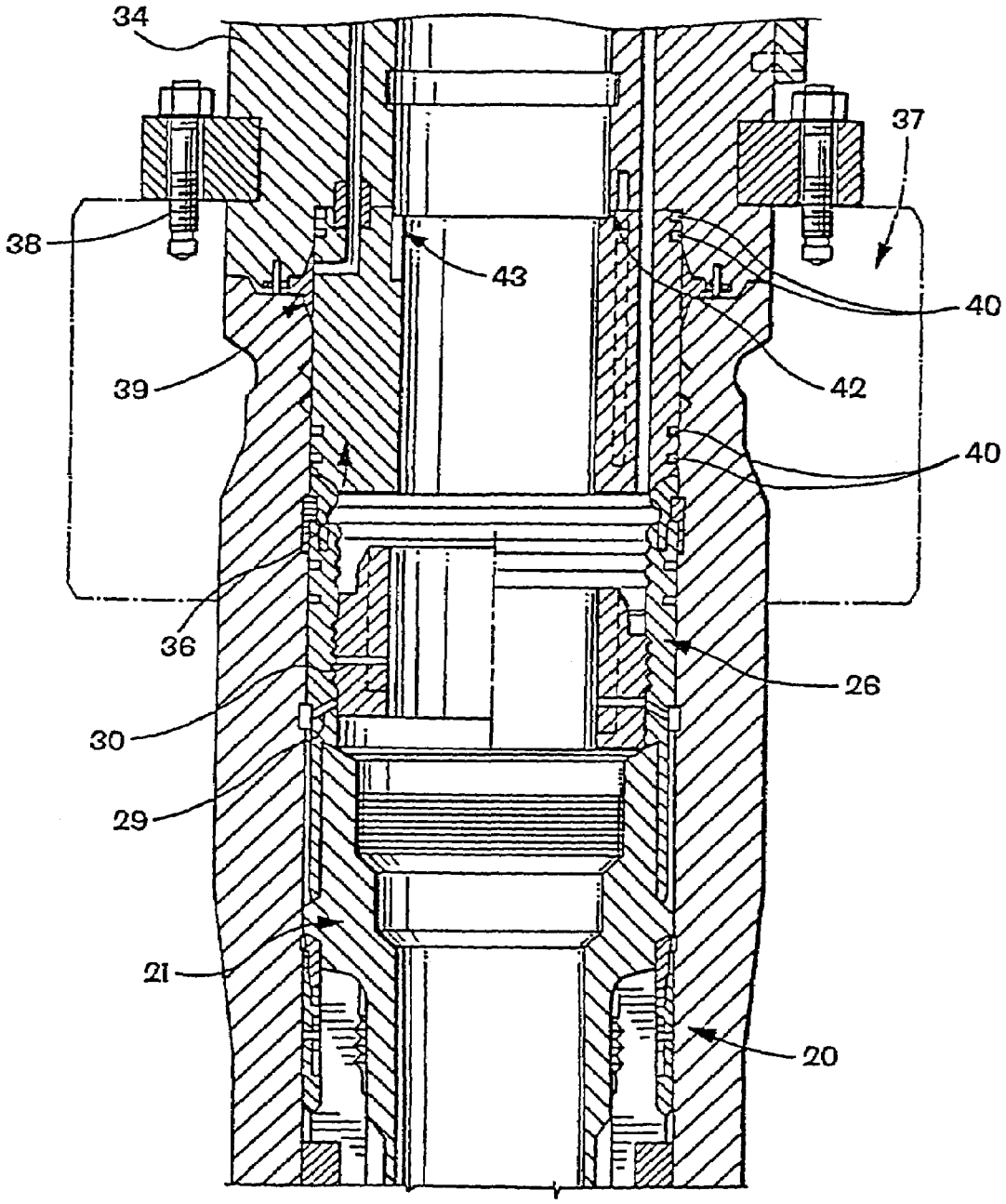

As shown in FIGS. 2 and 2A, the body of a tree spool 34 is then lowered on a tree installation tool 35, using conventional guide post location, or a guide funnel in case of deep water, until a spool tree mandrel 36 is guided into alignment with and slides as a close machined fit, into the upper end of the wellhead housing 20, to which the spool tree is then fixed via a production connector 37 and bolts 48. The mandrel 36 is actually a separate part which is bolted and sealed to the rest of the spool tree body. As seen particularly in FIG. 2A a weight set AX gasket 39, forming a metal to metal environmental seal is provided between the spool tree body and the wellhead housing 20. In addition two sets of sealing rings 40 provide, in series with the environmental seal, a production fluid seal externally between the ends to the spool tree mandrel 36 to the spool tree body and to the wellhead housing 20. The intervening cavity can be tested through a test part 40A. The provision of the adapter 26 is actually optional, and in its absence the lower end of the spool tree mandrel 36 may form a production seal directly with the production casing hanger 21. As is also apparent from reasons which will subsequently become apparent, the upper radially inner edge of the spool tree mandrel projects radially inwardly from the inner surface of the spool tree body above, to form a landing shoulder 42 and at least one machined key slot 43 is formed down through the landing shoulder.

Figure 3:
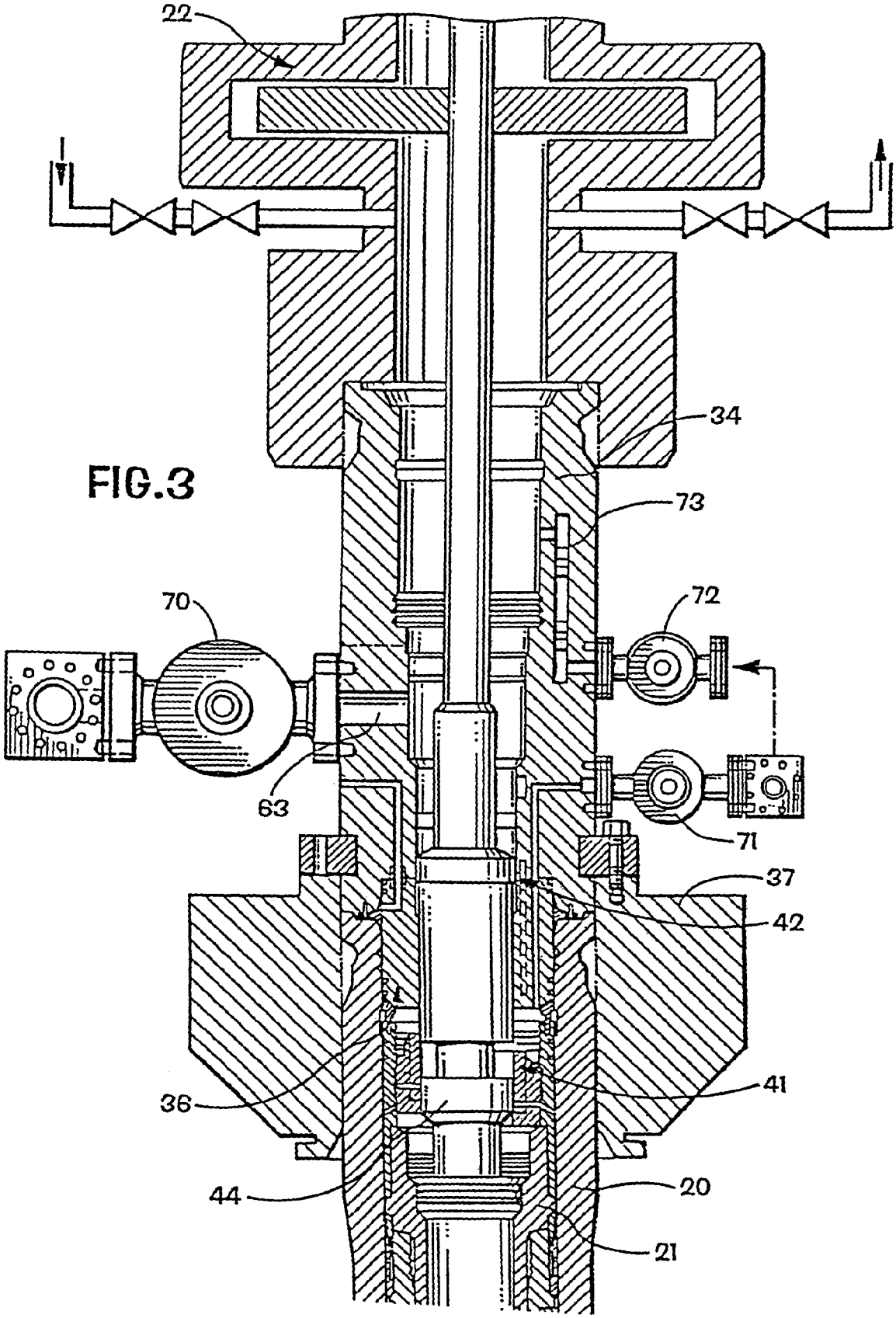

As shown in FIG. 3, the drilling BOP 22 is reinstalled on the spool tree 34. The tool 44 used to set the adapter in FIG. 1, having the spring dogs 45, is again run in until it lands on the shoulder 42, and the spring dogs 45 engage in the channels 33. The tool is then turned to screw the gland nut 28 down within the body 27 of the adapter 26 to the valve open position shown on the right hand side in FIG. 1A. It is now safe to open the production casing annulus as the well is protected by the BOP.

Figure 4:
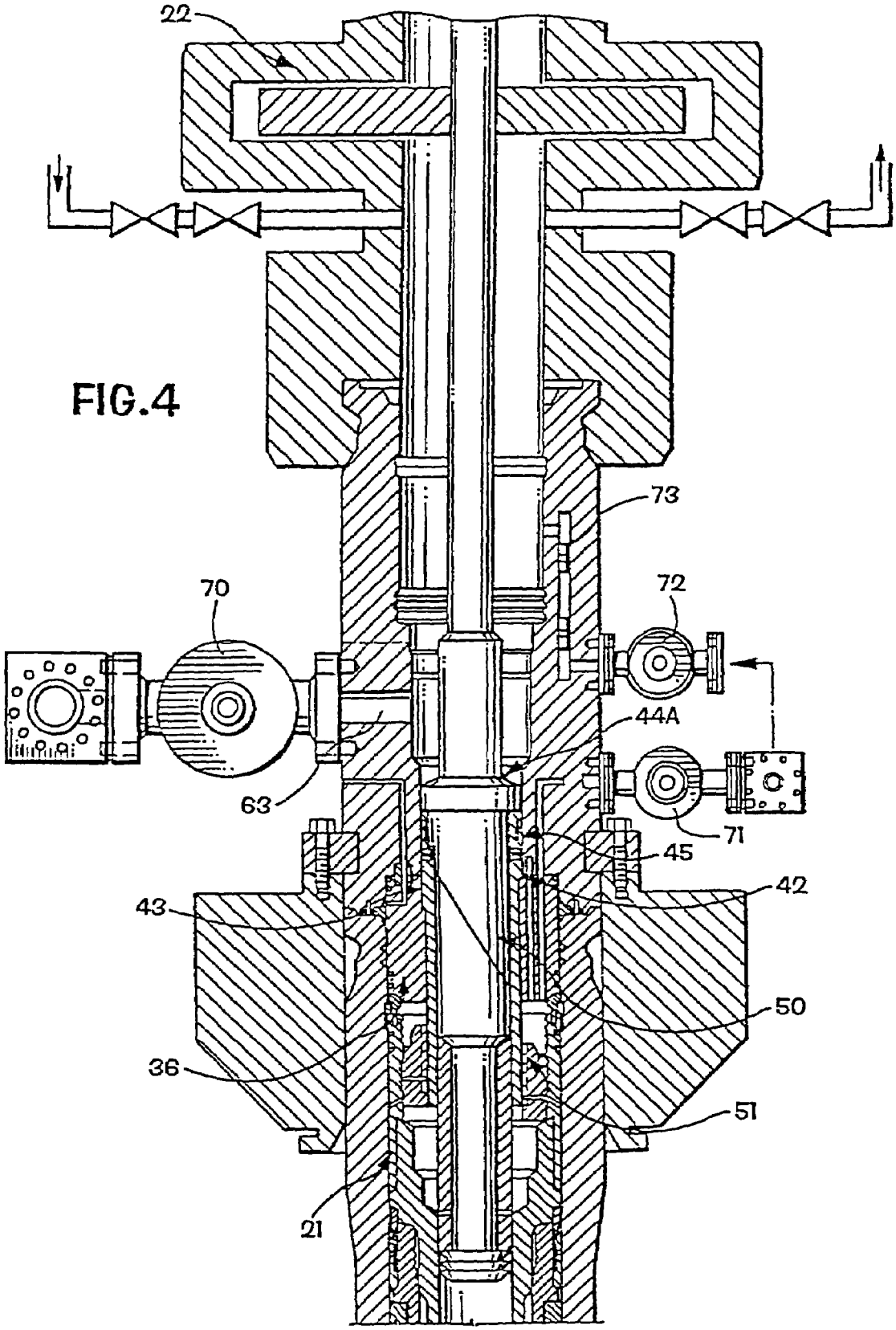
Figure 4A:
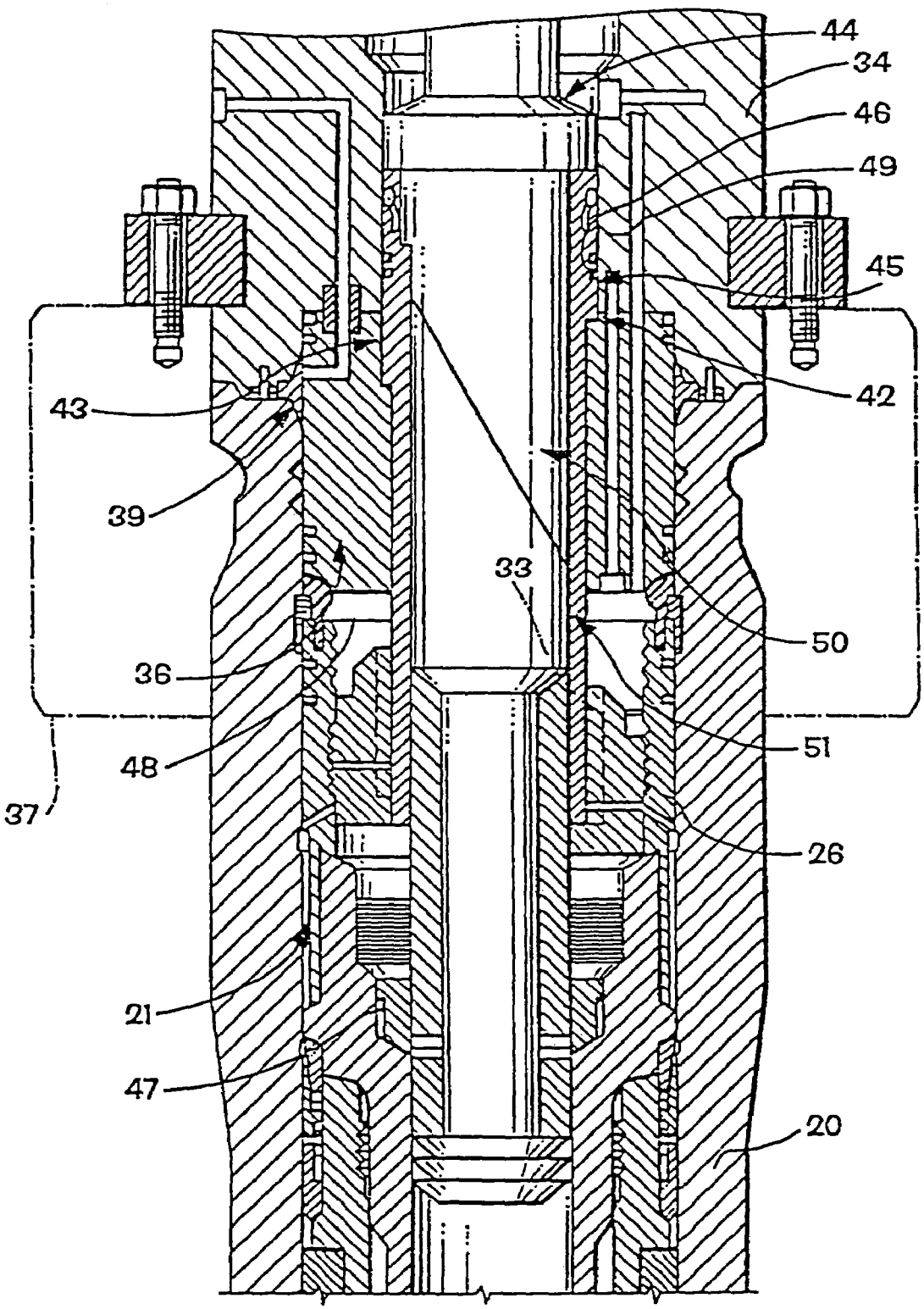

The next stage, show in FIGS. 4 and 4A, is to run in through the BOP and spool tree on an appropriate tool 44A a combined isolation and orientation sleeve 45. This lands on the shoulder 42 at the top of the spool tree mandrel and is rotated until a key on the sleeve drops into the mandrel key slot 43. This ensures precise angular orientation between the sleeve 45 and the spool tree 44, which is necessary, and in contrast to the angular orientation between the spool tree 34 and the wellhead casing, which is arbitrary. The sleeve 45 consists of an external cylindrical portion, an upper external surface of which in sealed by ring seals 46 to the spool tree 34, and the lower external surface of which is sealed by an annular seal 47 to the production casing hanger 21. There is thus provided between the sleeve 4S and the surrounding wellhead casing 20 a void 48 with which the channels 33, now defined radially inwardly by the sleeve 45, communicate. The void 48 in turn communicates via a duct 49 through the mandrel and body of the spool tree 34 to a lateral port. It is thus possible to monitor and vent the pressure in the production casing annulus through the passage provided past the production casing hanger via the conduits 32, 31 the ducts 29 and 30, the channels 33, shown in FIG. 1A, the void 48, the duct 49, and the lateral port in the spool tree. In the drawings, the radial portion of the duct 49 is shown apparently communicating with a tubing annulus, but this is draftsman's license and the ports from the two annul) are, in fact, angularly and radially spaced.

Within the cylindrical portion of the sleeve 45 is a lining, which may be fixed in the cylindrical portion, or left after internal machining of the sleeve. This lining provides an orientation sleeve having an upper/edge forming a cam 50. The lowermost portion of the cam leads into a key slot 51.

Figure 5:
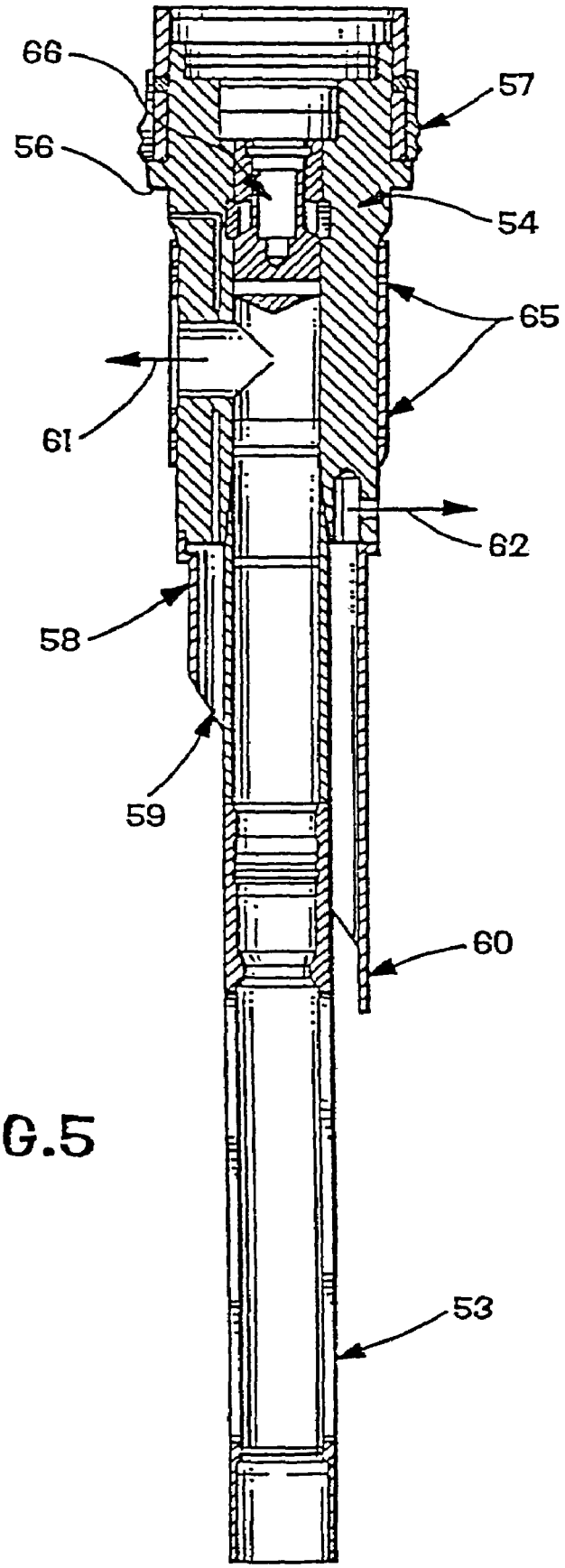
Figure 6:
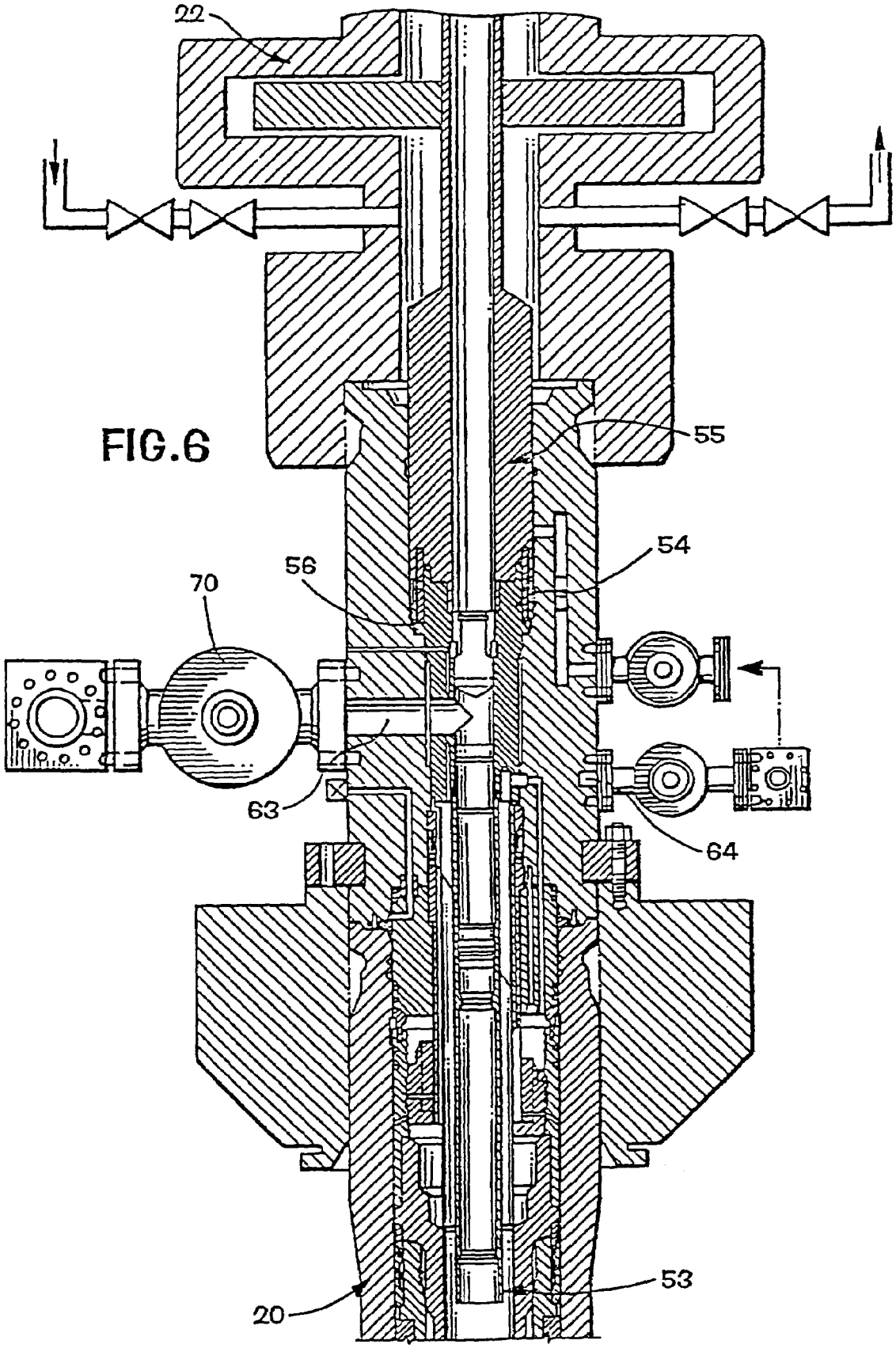
Figure 6A:
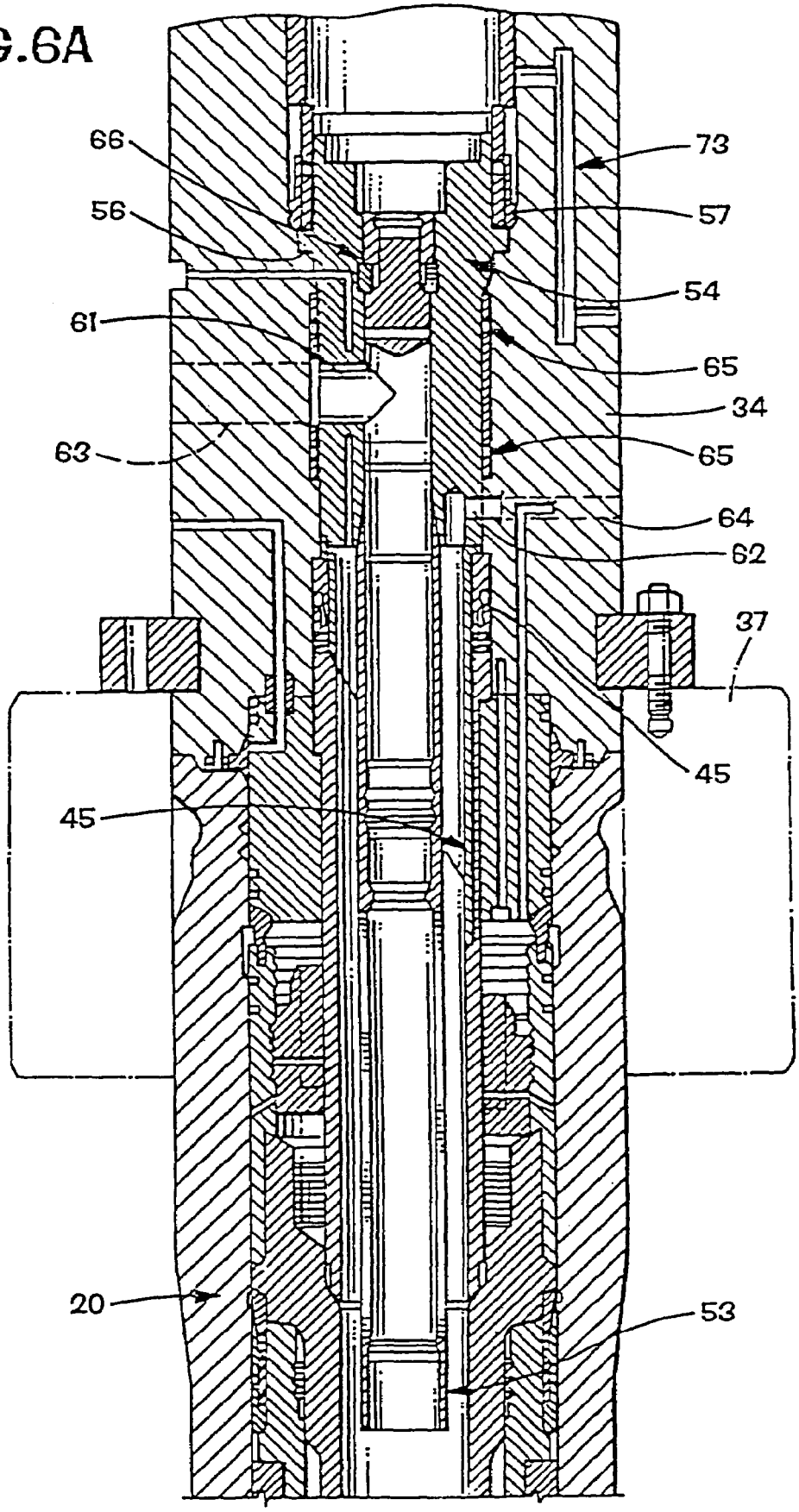

As shown in FIGS. 5, 6 and 6A a tubing string of production tubing 53 on a tubing hanger 54 is run in through the BOP 22 and spool tree 34 on a tool 55 until the tubing hanger lands by means of a keyed shoulder 56 on a landing in the spool tree and is locked down by a conventional mechanism 57. The tubing hanger 54 has a depending orientation sleeve 58 having an oblique lower edge forming a cam 59 which is complementary to the cam 50 in the sleeve 45 and, at the lower end of the cam, a downwardly projecting key 60 which i. complementary to the key slot 51. The effect of the cams 50 and 59 is that, irrespective of the angular orientation of the tubing string as it is run in, the cams will cause the tubing hanger 54 to be rotated to its correct angular orientation relatively to the spool tree and the engagement of the key 60 in the key slot 51 will lock this relative orientation between the tubing hanger and spool tree, so that lateral production and tubing annulus fluid flow ports 61 and 62 in the tubing hanger 54 are in alignment with respective lateral production and tubing annulus fluid flow ports 63 and 64 through the wall of the spool tree. Metal to metal annulus seals 65, which are set by the weight of the tubing string, provide production fluid seals between the tubing hanger 54 and the spool tree 34. Provision is made in the top of the tubing hanger 54 for a wireline set plug 66. The keyed shoulder 56 of the tubing hanger lands in a complementary machined step in the spool tree 34 to ensure ultimate machined accuracy of orientation between the tubing hanger 54 and the spool tree 34.

Figure 7:
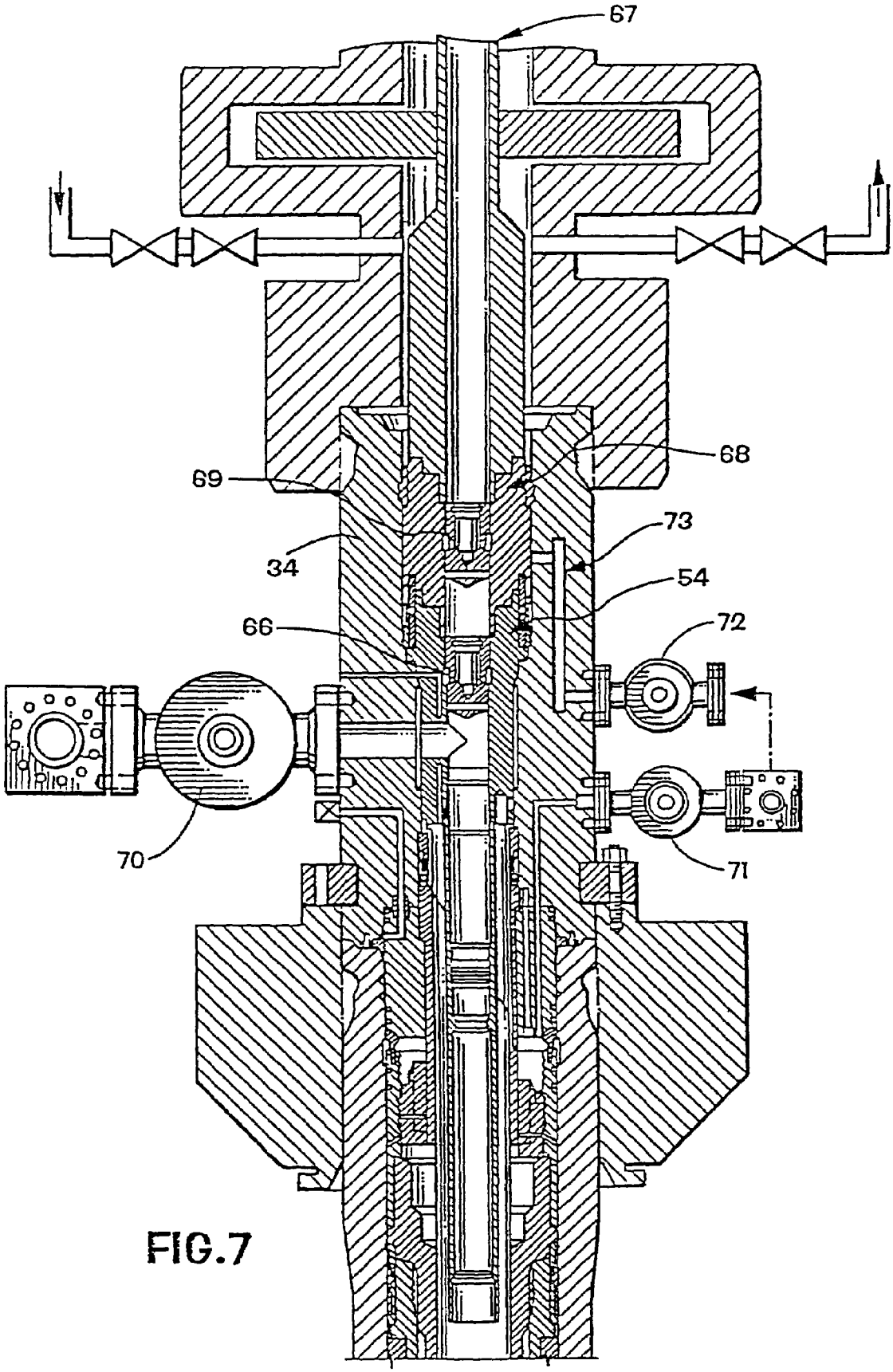

FIG. 7 shows the final step in the completion of the spool tree. This involves the running down on drill pipe 67 through the BOP, an internal isolation stopper 68 which seals within the top of the spool tree 34 and has an opening closed by an in situ wireline activated plug 69. The BOP can then be removed leaving the wellhead in production mode with double barrier isolation at the upper end of the spool tree provided by the plugs 66 and 69 and the stopper 68. The production fluid outlet is controlled by a master control valve 70 and pressure through the tubing annulus outlet ports 62 and 64 is controlled by an annulus master valve 71. The other side of this valve is connected, through a workover valve 72 to a lateral workover port 73 which extends through the wall of the spool tree to the void between the plugs 69 and 66. With this arrangement, wireline access to the tubing annulus in and downstream of a tubing hanger is unnecessary as any circulation of fluids can take place through the valves 71 and 72, the ports 62, 64 and 73, and the kill or choke lines of any BOP which has been installed. The spool tree in the completed production mode is shown in FIG. 8.

Figure 9:
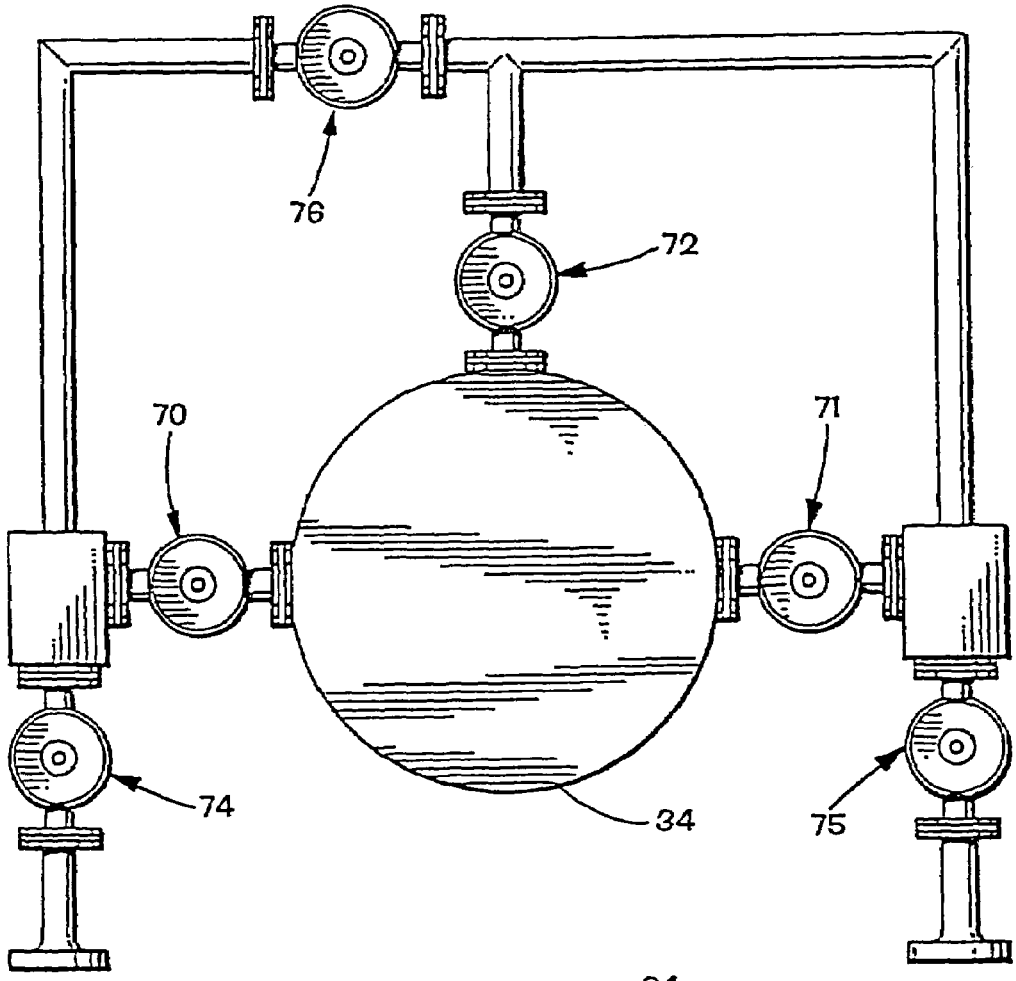
FIG. 9 is a circuit diagram showing external connections to the spool 3.

FIG. 9 shows valve circuitry associated with the completion and, in addition to the earlier views, shows a production fluid isolation valve 74, a tubing annulus valve 75 and a cross over valve 76. With this arrangement a wide variety of circulation can be achieved down hole using the production bore and tubing annulus, in conjunction with choke and kill lines extending from the BOP and through the usual riser string. All the valves are fail/safe closed if not actuated.

The arrangement shown in FIGS. 1 to 9 is a mono production bore wellhead which can be accessed by a single wireline or drill pipe, and the external loop from the tubing annulus port to the void between the two plugs at the top of the spools tree avoids the need for wireline access to the tubing annulus bore.

Figure 8:
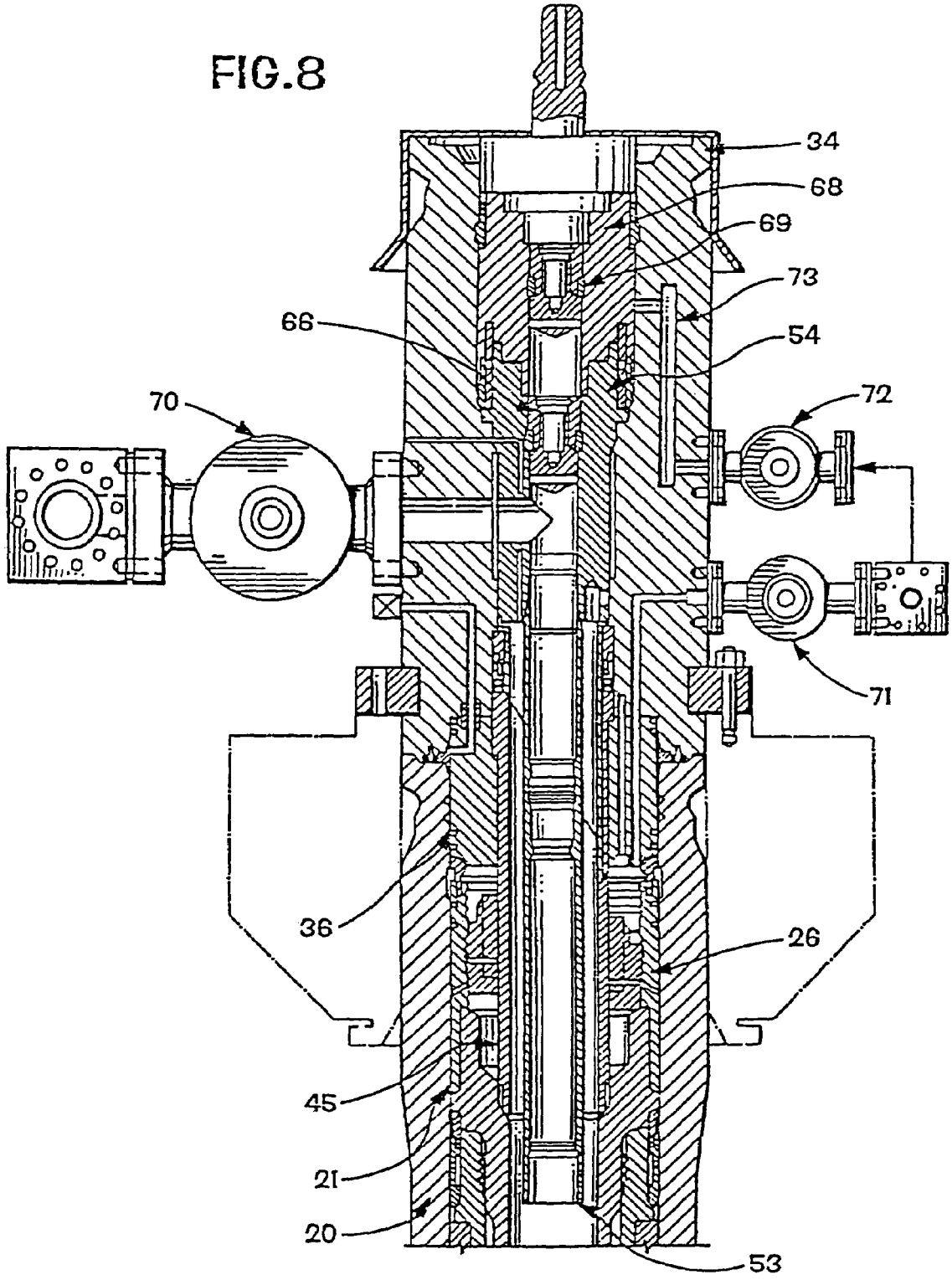
Figure 10:
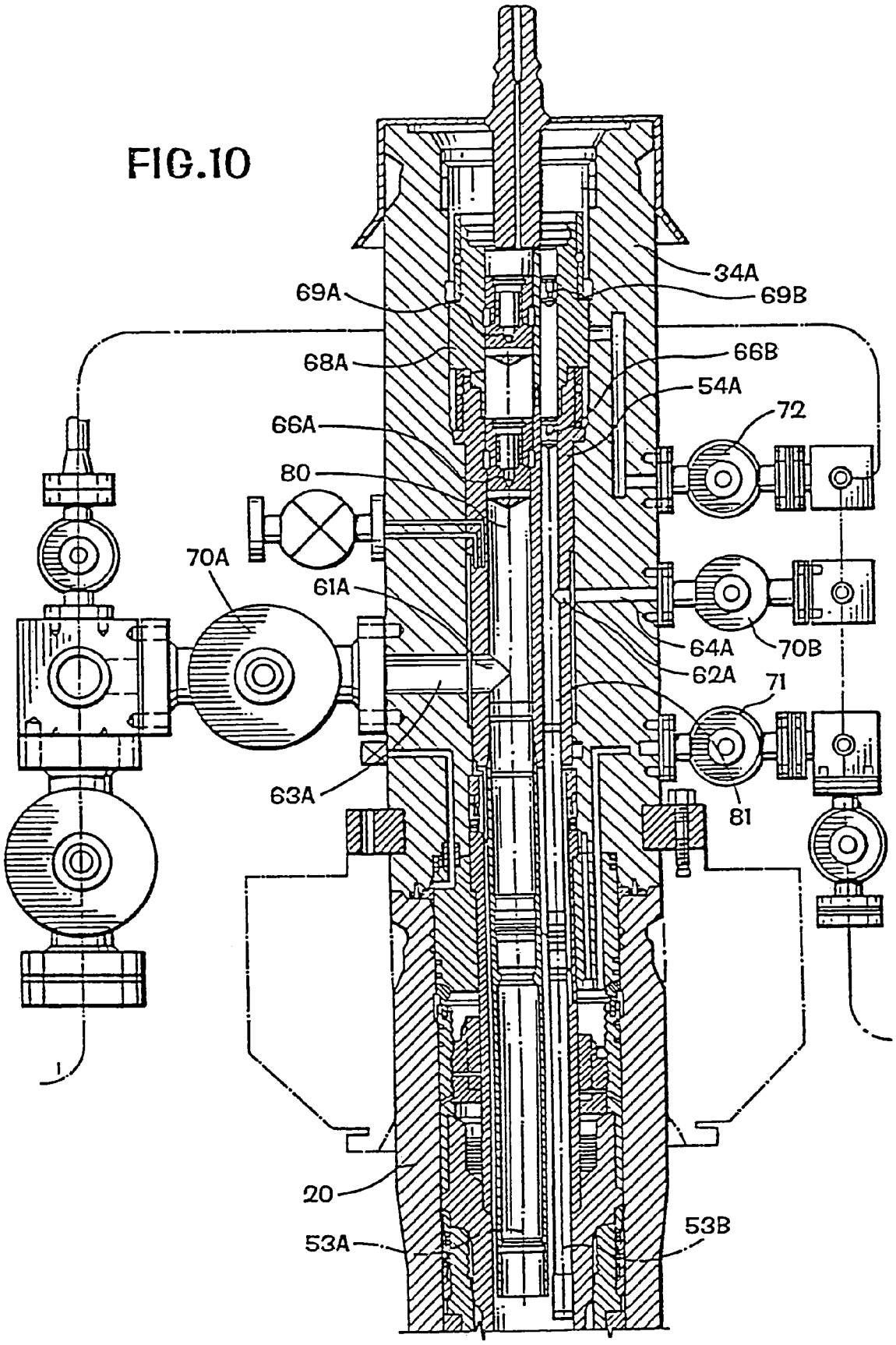
FIG. 10 is a vertical axial section through a completed dual production bore well in production mode.

FIG. 10 corresponds to FIG. 8 but shows a 5½ inch×2⅜ inch dual production bore wellhead with primary and secondary production tubing 53A and 53B. Development and completion are carried out as with the monobore wellhead except that the spool tree 34A and tubing hanger 54A are elongated to accommodate lateral outlet ports 61A, 63A for the primary production fluid flow from a primary bore 80 in the tubing hanger to a primary production master valve 70A, and lateral outlet ports 62A, 64A for the secondary production fluid flow from a secondary bore 81 in the tubing hanger to a secondary production master valve 70B. The upper ends of the bores 80 and 81 are closed by wireline plugs 66A and 66B. A stopper 68A, which closes the upper end of the spool tree 34A has opening-, in alignment with the plugs 66A and 66B, closed by wireline plugs 69A and 69B.

Figure 13:
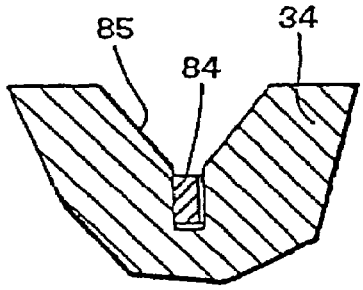
Figure 13A:
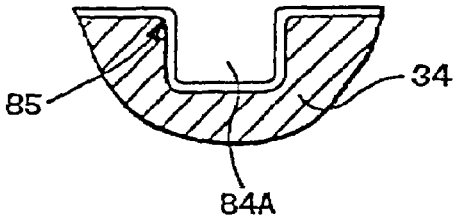
Figure 13B:
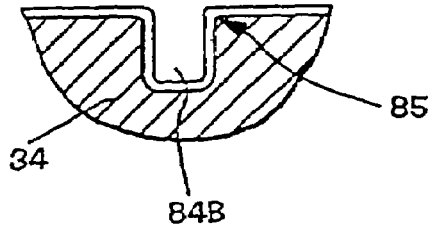
Figure 11:
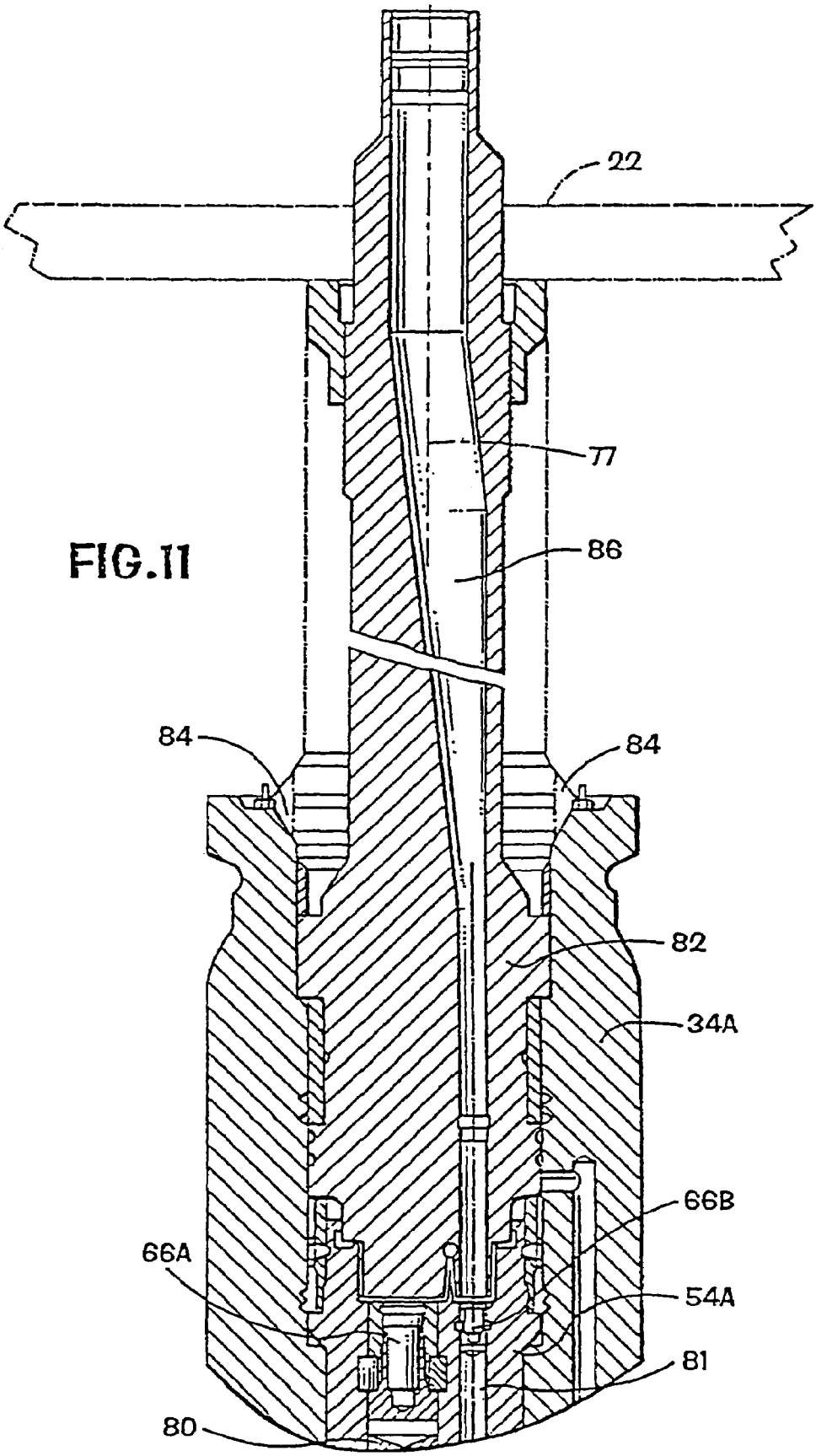
FIGS. 11 and 12 are vertical axial sections showing alternative connectors to the upper end of the dual production bore wellhead during work over, and, FIG. 13 is a detail showing the seating of one of the connectors in the spool tree.
Figure 12:
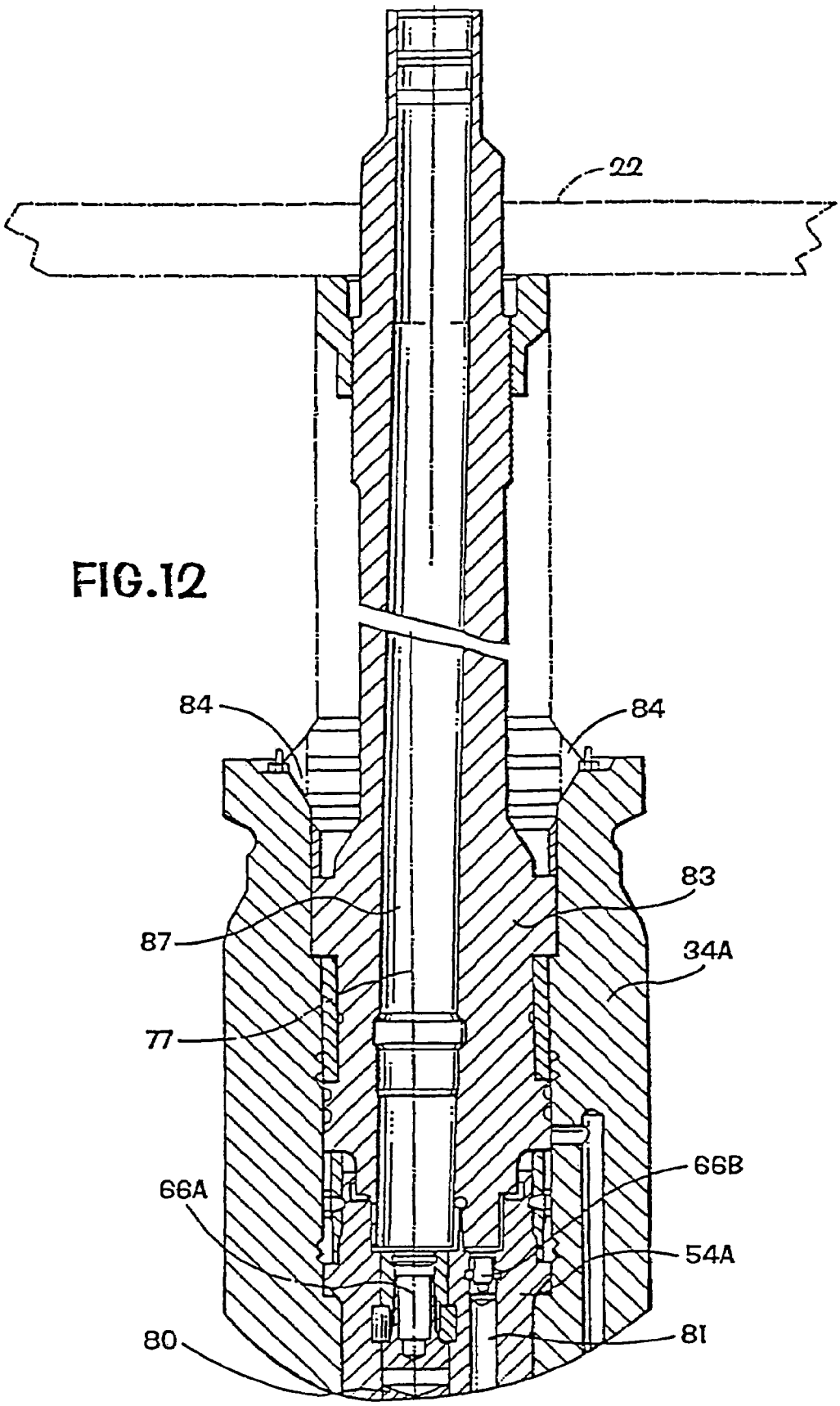

FIGS. 11 and 12 show how a wireline 77 can be applied through a single drill pipe to activate selectively one or other of the two wireline plugs 66A and 66B in the production bores 80 and 81 respectively. This involves the use of a selected one of two connectors 82 and 83. In practice, a drilling BOP 22 is installed and the stopper 68A is removed. Thereafter the connector 82 or 83 is run in on the drill pipe or tubing until it lands in, and is secured and sealed to the spool tree 34A. FIG. 13 shows how the correct-angular orientation between the connector 82 or 83 and the spool tree 34A, is achieved by wing keys 84, which are guided by Y-shaped slots 85 in the upper inner edge of the spool tree, first to bring the connectors into the right angular orientation, and then to allow the relative axial movement between the parts to enable the stabbing function when the wireline connector engages with its respective pockets above plug 66A or 66B. To ensure equal landing forces and concentricity on initial contact, two keys 84A and 84B are recommended. As the running tool is slowly rotated under a new control weight, it is essential that the tool only enters in one fixed orientation. To ensure this key 84A is wider than key 84B and its respective Y-shaped slots. It will be seen that one of the connectors 82 has a guide duct 86 which leads the wireline to the plug 66B whereas the other connector 83 has a similar guide duct 87 which leads the wireline to the other plug 66A.

The invention claimed is:

1. A well production assembly for installation on a wellhead comprising in combination:

a production tree having a vertical axis, an axially extending bore, and a lateral production passage extending from the bore through a sidewall of the tree transverse to the vertical axis;

a shoulder formed in the tree;

a tree auxiliary passage extending through the sidewall of the tree and having an auxiliary connector located at the shoulder;

a string of tubing extending into a well;

a tubing hanger which lands sealingly in the bore and is connected to the string of tubing, the tubing hanger having a lateral production passage extending from a co-axial production passage co-axial with the axially extending bore and extending axially through the tubing hanger, the lateral production passage aligning with the lateral production passage of the tree; and a mandrel adapted to be disposed in the wellhead and having a mandrel auxiliary passage extending therethrough, the auxiliary connector in the tree sealingly mating with the auxiliary passage when the tree lands on the wellhead to communicate the tree auxiliary passage with the mandrel auxiliary passage.

2. The well production assembly of claim 1 wherein the mandrel auxiliary passage is used to test a seal between the wellhead and production tree.

3. The well production assembly of claim 1 wherein the tubing hanger has an offset vertical passage extending through the tubing hanger from a lower end to an upper end of the tubing hanger offset from the co-axial production passage and a lateral flow passageway which extends laterally from the co-axial production passageway through the tubing hanger and has an outlet at the exterior of the tubing hanger which registers with the inlet of a lateral flow passage in the tree.

4. A well production assembly for installation on a wellhead having a casing hanger supported therein and for receiving tubing suspended from a tubing hanger, the assembly comprising:

a production tree having a central bore;

a gasket adapted to seal the production tree and wellhead;

a mandrel disposed on the production free and having a bore therethrough adapted for receiving the tubing, the mandrel having a first end adapted to extend into the wellhead and a second end extending into the production tree; and the first end having a first seal adapted to sealingly engage the wellhead or casing hanger below the gasket and the second end having a second seal sealingly engaging the production tree above the gasket.

5. The well production assembly of claim 4 wherein the mandrel is adapted to have a machined fit within the wellhead.

6. The well production assembly of claim 4 wherein the mandrel forms an upwardly facing support shoulder.

7. The well production assembly of claim 4 wherein the mandrel includes a key slot for receiving a key.

8. The well production assembly of claim 4 further including a fluid port extending through the wall of the production tree to an opening below the second seal.

9. A well production assembly for installation on a wellhead having a casing hanger supported therein, the assembly comprising:

a production tree having a central bore;

a gasket adapted to seal the production tree and wellhead;

a mandrel disposed on the production tree arid having a first end adapted to extend into the wellhead and a second end extending into the production tree;

the first end having a first seal adapted to sealingly engage the wellhead or casing hanger below the gasket and the second end having a second seal sealingly engaging the production tree above the gasket; and a port extending through the wall of the production tree to an opening below the second seal;

wherein the port extends through the mandrel.

10. The well production assembly of claim 9 further including a stab to connect the port through the production tree and the mandrel.

11. A well production assembly for installation on a wellhead having a casing hanger supported therein, the assembly comprising:

a production tree having a central bore;

a gasket adapted to seal the production tree and wellhead;

a mandrel disposed on the production tree and having a first end adapted to extend into the wellhead and a second end extending into the production tree;

the first end having a first seal adapted to sealingly engage the wellhead or casing hanger below the gasket and the second end having a second seal sealingly engaging the production tree above the gasket; and a duct extending through the mandrel and the wall of the production tree.

12. The well production assembly of claim 11 further including a flowpath interiorly of the mandrel to the duct.

13. A well production assembly for installation on a wellhead having a casing hanger supported therein, the assembly comprising:

a production tree having a central bore;

a gasket adapted to seal die production tree and wellhead;

a mandrel disposed on the production tree and having a first end adapted to extend into the wellhead and a second end extending into the production tree; and the first end having a first seal adapted to sealingly engage the wellhead or casing hanger below the gasket and the second end having a second seal sealingly engaging the production tree above the gasket;

wherein the production tree is a horizontal tree having a lateral production bore extending from the central bore through a wall of the horizontal tree, the horizontal tree including an annulus port extending through the wall of the horizontal tree.

14. The well production assembly of claim 13 further including a flowpath interiorly of the mandrel to the annulus port.

15. A well production assembly for installation on a wellhead having a casing hanger supported therein, the assembly comprising:

a production tree having a central bore and a lateral production bore extending from the central bore through a wall of the production tree;

a gasket adapted to seal the production tree and wellhead;

a mandrel having a first end adapted to extend into the wellhead and a second end extending into the production tree;

the first end having a first seal adapted to sealingly engage the wellhead or casing hanger below the gasket and the second end having a second seal sealingly engaging the production tree above the gasket, thereby forming a cavity;

a test port extending through the wall of the production tree to the cavity; and the mandrel having an orientation surface.

16. The well production assembly of claim 15 further including a tubing hanger landed sealingly in the central bore and connected to a string of tubing, the tubing hanger having a vertical production passage and a lateral production passage extending from the vertical production passage aligning with the lateral production bore of the production tree and the orientation surface being used to orient the tubing hanger within the production tree.

17. The well production assembly of claim 16 thither including a valve controlling flow through the test port.

18. A well production assembly for installation on a wellhead having a casing hanger supported therein, the assembly comprising:

a horizontal tree having a central bore and a lateral production bore extending from the central bore through a wall of the horizontal tree;

a gasket adapted to seal the horizontal tree and wellhead;

a mandrel disposed on the horizontal tree and having a first end adapted to extend into the wellhead and a second end extending into the horizontal tree;

the fast end having a first seal adapted to sealingly engage the wellhead or casing hanger below the gasket and the second end having a second seal sealingly engaging the horizontal tree above the gasket thereby forming a cavity;

a test port extending through the wall of the production tree to the cavity;

a valve controlling flow through the test port;

the mandrel having an orientation surface;

a tubing hanger sealingly landed in the central bore and connected to a string of tubing, the tubing hanger having a vertical production passage and a lateral production passage extending from the vertical production passage aligning with the lateral production bore of the production tree;

the orientation surface being used to orient the tubing hanger within the production tree;

the tubing hanger having an annulus port and the tubing string forming a tubing annulus; and a flowpath extending interiorly of the mandrel for fluid flow between the tubing annulus and the annulus port.

19. A method for completing a well with a wellhead supporting a hanger, comprising:

lowering a horizontal tree suspending a mandrel into the well;

forming a metal-to-metal seal between the horizontal tree and wellhead;

extending the mandrel into the wellhead;

sealing the mandrel with the horizontal tree and the wellhead or hanger;

forming a cavity adjacent the metal-to-metal seal;

testing the metal-to-metal seal by applying pressure through a test port extending from the exterior of the horizontal tree to the cavity.

20. The method of claim 19 further including installing a tubing hanger and tubing within the horizontal tree and flowing fluids from an annulus around the tubing and interiorly of the mandrel for fluid flow through an annulus port in a wall of the horizontal tree.

* * * * *